US007296637B2

(12) United States Patent
Gudac

(10) Patent No.: US 7,296,637 B2
(45) Date of Patent: Nov. 20, 2007

(54) OIL DRILLING TOOL

(76) Inventor: Ed Gudac, 903 W. 2500 South, Vernal, UT (US) 84078

( * ) Notice: Subject to any disclaimer, the term of this patent is extended or adjusted under 35 U.S.C. 154(b) by 247 days.

(21) Appl. No.: 11/100,891

(22) Filed: Apr. 6, 2005

(65) Prior Publication Data

US 2005/0217897 A1 Oct. 6, 2005

Related U.S. Application Data

(60) Provisional application No. 60/560,201, filed on Apr. 6, 2004.

(51) Int. Cl.
*E21B 49/08* (2006.01)

(52) U.S. Cl. ..... 175/40; 175/317; 175/324; 166/332.4

(58) Field of Classification Search ..... 175/317, 175/324, 40, 57; 166/205.01, 250.17, 332.4, 166/332.5

See application file for complete search history.

(56) References Cited

U.S. PATENT DOCUMENTS 3,335,802 A * 8/1967 Seyffert, III ..... 166/332.4
4,149,593 A 4/1979 Gazda et al.
4,278,130 A 7/1981 Evans et al.
4,280,561 A * 7/1981 Fredd ..... 166/332.4
4,373,583 A 2/1983 Waters
4,462,465 A 7/1984 Strickland
4,624,317 A 11/1986 Barrington
4,669,537 A 6/1987 Rumbaugh
4,830,107 A 5/1989 Rumbaugh
5,167,278 A 12/1992 Goldschild
5,183,114 A * 2/1993 Mashaw et al. ..... 166/319
5,211,241 A 5/1993 Mashaw et al.
5,289,875 A 3/1994 Stokley et al.
5,372,193 A 12/1994 French
5,375,478 A 12/1994 Bernhardt
5,564,500 A * 10/1996 Rogers et al. ..... 166/312
5,636,694 A 6/1997 Mireles, Jr. et al.
5,947,200 A 9/1999 Montgomery
6,330,913 B1 12/2001 Langseth et al.
6,343,650 B1 2/2002 Ringgenberg
6,763,892 B2 7/2004 Kaszuba
2002/0023782 A1 2/2002 Appleton et al.
2002/0053426 A1 5/2002 Kelley et al.
2004/0045709 A1 3/2004 Zuklic et al.
2004/0129456 A1 7/2004 Vail, III

* cited by examiner

*Primary Examiner*—Hoang Dang
(74) *Attorney, Agent, or Firm*—Vidal A. Oaxaca; Peacock Myers, P.C.

(57) ABSTRACT

The present invention comprises a drilling tool assembly for drilling oil comprising a bit release subassembly, a test sleeve that is removable to open and close flow ports, and a profile nipple.

10 Claims, 2 Drawing Sheets

OIL DRILLING TOOL

CROSS-REFERENCES TO RELATED APPLICATIONS

This application claims the benefit of the filing of U.S. Provisional Patent Application Ser. No. 60/560,201, entitled "Bit Release Test Sleeve", filed Apr. 6, 2004, and the specification thereof is incorporated herein by reference.

BACKGROUND OF THE INVENTION

1. Field of the Invention (Technical Field)

The present invention relates to an oil drilling tool assembly comprising a bit release subassembly, a test sleeve that is removable to open and close flow ports, and a profile nipple.

2. Description of Related Art

Note that the following discussion refers to a number of publications by author(s) and year of publication, and that due to recent publication dates certain publications are not to be considered as prior art vis-a-vis the present invention. Discussion of such publications herein is given for more complete background and is not to be construed as an admission that such publications are prior art for patentability determination purposes.

Well bore tool assemblies used in the oil drilling industry may include a sliding sleeve that opens flow ports. However, when utilizing a bit release subassembly, no sliding sleeve and/or profile nipple are typically included in the tool assembly. A bit release subassembly is a component of a drilling tool assembly that is designed to detach from the overall assembly when the assembly is ready to be placed in production mode. When the bit release subassembly is released, the drill bit is also released to fall to the bottom of a well. Sliding sleeves are incorporated into a tool assembly so that when activated, flow ports are opened. If a sliding sleeve is combined with a bit release subassembly, it is activated to open the flow ports in conjunction with other events, such as pumping off (i.e., releasing) the bit release subassembly, that prevent further testing. Therefore, multiple zones cannot be tested individually when testing a well. Also, combining a sliding sleeve and a bit release subassembly would result in an assembly of excessive length because, for example, the tools would have to be spaced apart at a pup joint to function properly.

An apparatus or method is needed that provides the ability to put the drilling apparatus in a test-flow position by opening the flow ports, then return the apparatus to a drill-out position to continue testing multiple zones down into the well that is being tested.

BRIEF SUMMARY OF THE INVENTION

The present invention comprises a drilling tool comprising a profile nipple, a test sleeve disposed in the profile nipple, and a bit release subassembly attached to the profile nipple. The test sleeve is preferably removable. The tool preferably comprises an integral collet and/or replaceable seals. The seals preferably comprise field redressable, crimped seals.

The profile nipple preferably comprises an "F" profile nipple. The tool further preferably comprises a notched collar at a lower end of the profile nipple.

The present invention also comprises a method for drilling and testing zones comprising providing a profile nipple, disposing a test sleeve in the profile nipple, and attaching a bit release subassembly to the profile nipple. The invention further comprises drilling into a well until a first well zone of interest is reached, removing the test sleeve to allow for flow through at least one flow port, returning the test sleeve into position to close the at least one flow port after testing the first well zone, continuing drilling until a second well zone of interest is reached and repeating the steps until drilling and testing is complete, and releasing the bit release subassembly.

A primary object of the present invention is to provide for the testing of multiple zones as drilling into a well continues.

A primary advantage of the present invention is that time and costs are reduced when drilling and testing wells.

Other objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated into and form a part of the specification, illustrate one or more embodiments of the present invention and, together with the description, serve to explain the principles of the invention. The drawings are only for the purpose of illustrating one or more preferred embodiments of the invention and are not to be construed as limiting the invention. In the drawings.

DETAILED DESCRIPTION OF THE INVENTION

Figure 1:
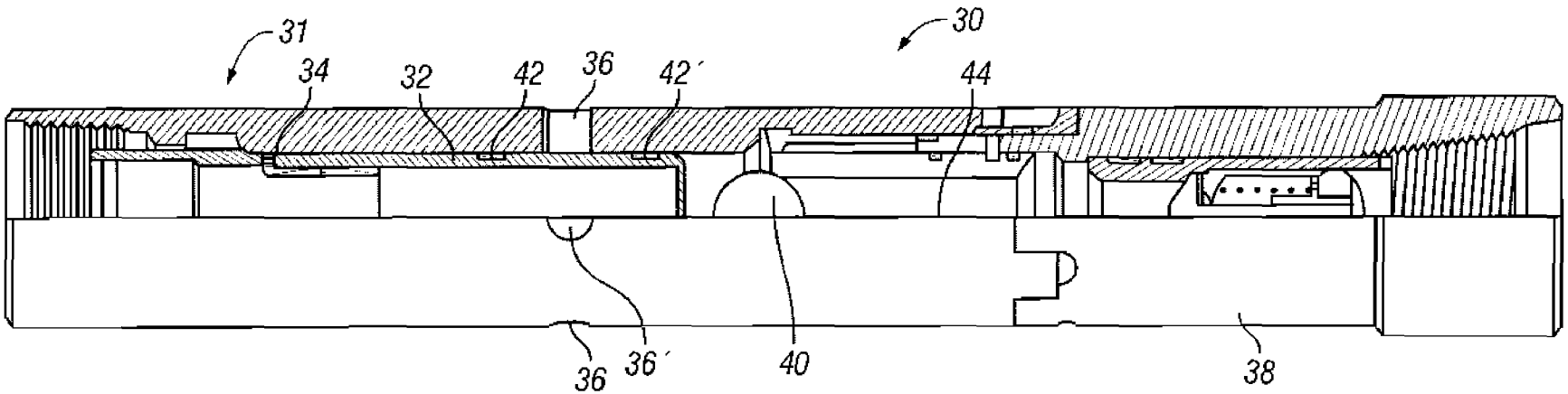
FIG. 1 is a cross-sectional view of the preferred embodiment of the tool assembly of the present invention in the drill-out position.
Figure 2:
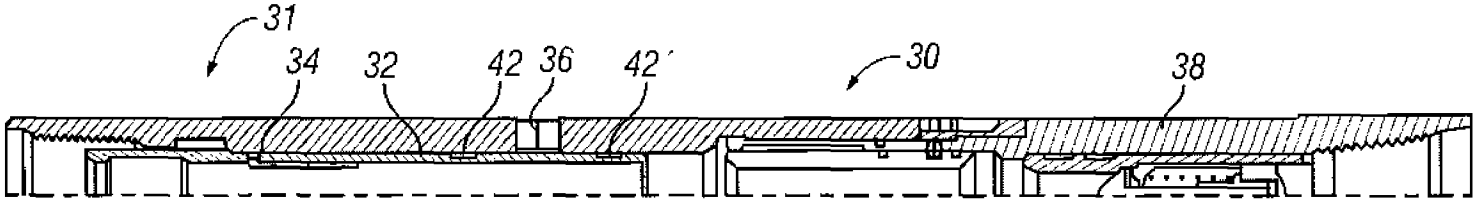
FIG. 2 is another cross-sectional view of the assembly in the drill-out position.

The present invention comprises a tool assembly for oil drilling that comprises a test sleeve (i.e., an isolation sleeve), a bit release subassembly, and a profile nipple. FIGS. 1 and 2 show a cross-sectional view of the preferred embodiment of drilling tool assembly 30 and profile nipple 31. Test sleeve 32 is an isolation sleeve that is removable. Test sleeve 32 may be removed by various methods known in the art such as by utilizing industry standard wireline procedures and tools. Although in the preferred embodiment, and as described more fully herein, the drilling tool is for use in oil drilling, the use of the apparatus and the method of the present invention encompasses the drilling for any fluid or gas, and such is within the scope of the present invention.

Test sleeve 32 is locked into place by integral collet 34. Although the use of components such as bonded seals may be utilized, the preferred embodiment preferably comprises replaceable seals 42, 42' with test sleeve 32. Seals 42, 42' are essentially as described in U.S. Pat. No. 4,632,406, the specification and claims of which are incorporated herein by reference. Combining the use of sleeve 32 in assembly 30 allows for a reduced length of assembly 30.

In the preferred embodiment, profile nipple 31 comprises an "F" profile. Although an "F" profile nipple is depicted and described herein, any type profile nipple may be utilized in accordance with the present invention. By way of example, industry standard EU coupling OD above API connection may be utilized.

Figure 3:
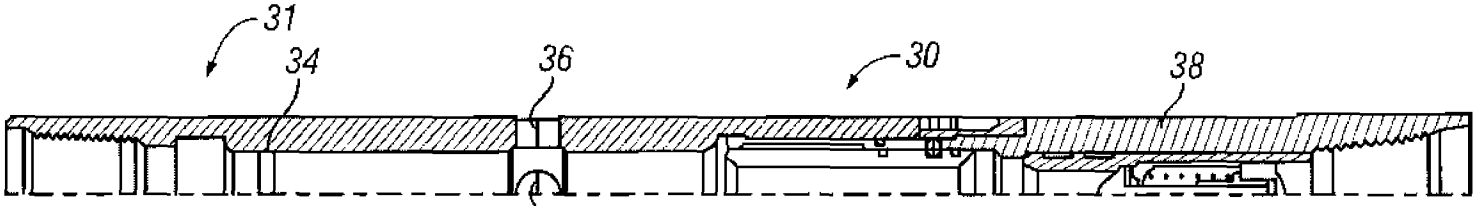
FIG. 3 is a cross-sectional view of the assembly in the test-flow position.
Figure 4:
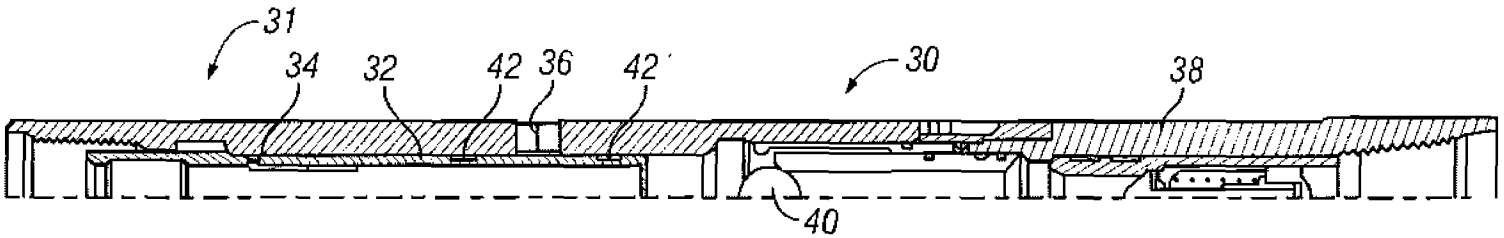
FIG. 4 is a cross-sectional view of the assembly in the pump-off position.
Figure 5:
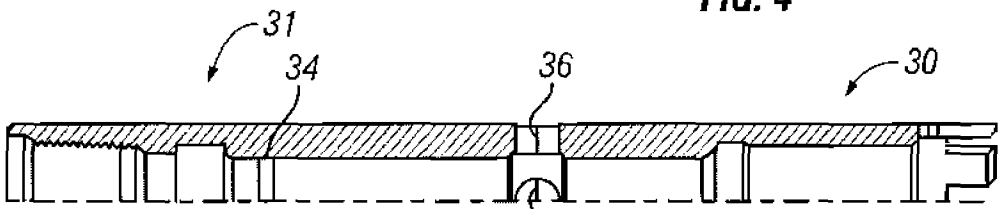
FIG. 5 is a cross-sectional view of the assembly in the production position.

FIG. 3 shows that upon removal of test sleeve 32, flow ports 36, 36', and 36" are preferably opened to allow for testing. Bit release subassembly 38 preferably remains attached to assembly 30 during testing. Upon completion of testing, bit release subassembly 38 is preferably pumped off (i.e., released) as shown in FIG. 4. In the preferred embodiment, as practiced in the art, ball 40 is circulated down assembly 30 so that it seats to cause bit release subassembly 38 to separate from assembly 30. Other means known in the art for releasing bit release subassembly 38 are encompassed in the present invention, including mechanical release. FIG. 5 shows assembly 30 in its production configuration with bit release subassembly 38 no longer attached. In the production configuration, test sleeve 32 is optionally left in place or removed.

In the preferred embodiment, assembly 30 is used to drill down a well until it reaches a well zone of interest. Test sleeve 32 is then preferably removed to allow for flow through flow ports 36, 36', and 36". When testing is complete, test sleeve 32 is preferably returned to its position in assembly 30, and drilling is continued to the next zone of interest. This process may be repeated as desired. When drilling is complete, bit release subassembly 38 is preferably released.

The combination of assembly 30 provides the ability to continue drilling after a zone is tested. The design of test sleeve 32 makes a larger flow area possible during testing. It should be understood that test sleeve 32 may be incorporated into any design, apparatus, assembly, etc. where the opening and closing of any type of flow port/opening is desired or required and such use is encompassed within the scope of the present invention.

In another embodiment, notched collar 44 (shown in FIG. 1) may be incorporated at the lower end of nipple 31 to allow the removal of sand without affecting the production of the well.

In another embodiment, the invention provides a method for test-flow positioning at multiple depths or zones by means of removably positioning test sleeve 32, which may be activated without detachment of the bit, thereby allowing the testing of multiple zones.

EXAMPLE

An apparatus as described herein was constructed and tested. The design included the following non-limiting characteristics:

1. an overall 3 1/16 inch O.D.;
2. an OTIS 40GS17800 Fishing Profile;
3. a 1.781 inch "F" Profile nipple;
4. an isolation test sleeve;
5. an integral locking collet;
6. a set of field redressable crimp seals;
7. a bit release subassembly; and
8. a notched collar assembly.

The tool assembly functioned properly and was successfully used to test multiple well zones without a need to pump off (i.e., release) the drill bit.

Although the invention has been described in detail with particular reference to these preferred embodiments, other embodiments can achieve the same results. Variations and modifications of the present invention will be obvious to those skilled in the art and it is intended to cover all such modifications and equivalents.

What is claimed is:

1. A drilling tool comprising:

a profile nipple;

at least one flow opening disposed in said profile nipple for providing communication between an inner portion of said profile nipple and a fluid or gas in a well hole to allow the fluid or gas to enter said inner portion of said profile nipple for testing of the fluid or gas while said drilling tool is in the well hole;

a movable test sleeve disposed in said profile nipple to cover or open said at least one flow opening as said test sleeve moves; and a removable bit release subassembly attached to said profile nipple, said bit release subassembly removable while said bit release subassembly is in the well hole.

2. The tool of claim 1 further comprising an integral collet.

3. The tool of claim 1 further comprising replaceable seals.

4. The tool of claim 3 wherein said replaceable seals are field redressable, crimped seals.

5. The tool of claim 1 wherein said profile nipple comprises an "F" profile nipple.

6. The tool of claim 1 further comprising a notched collar at a lower end of said profile nipple.

7. A method for drilling and testing zones comprising the steps of:

providing a tool comprising a profile nipple;

disposing a test sleeve in the profile nipple;

drilling into a well until a first well zone of interest is reached;

removing the test sleeve to allow for flow through at least one flow port; and returning the test sleeve into position to close the at least one flow port after testing the first well zone.

8. The method of claim 7 further comprising the steps of:

drilling into said well until a second well zone of interest is reached;

removing the test sleeve to allow for flow through at least one flow port; and returning the test sleeve into position to close the at least one flow port after testing the second well zone.

9. The method of claim 7 further comprising the steps of:

drilling into said well until at least one other, subsequent zone of interest is reached;

removing the test sleeve to allow for flow through at least one flow port;

returning the test sleeve into position to close the at least one flow port after testing the at lest one other, subsequent well zone; and repeating the steps until drilling and testing is completed.

10. The method of claim 9 further comprising the steps of:

attaching a bit release subassembly to the profile nipple; and releasing the bit release subassembly after testing is completed.

* * * * *